US010954579B2

(12) United States Patent
Skrikerud et al.

(10) Patent No.: US 10,954,579 B2
(45) Date of Patent: Mar. 23, 2021

(54) PARTIAL RADIATION HEATING METHOD FOR PRODUCING PRESS HARDENED PARTS AND ARRANGEMENT FOR SUCH PRODUCTION

(71) Applicant: Automation, Press and Tooling, AP & T AB, Tranemo (SE)

(72) Inventors: Martin Skrikerud, Trachlau (CH); Christian Koroschetz, Gothenburg (SE); Kent Eriksson, Marstrand (SE)

(73) Assignee: AUTOMATION, PRESS AND TOOLING, AP & T AB, Tranemo (SE)

( * ) Notice: Subject to any disclaimer, the term of this patent is extended or adjusted under 35 U.S.C. 154(b) by 96 days.

(21) Appl. No.: 15/769,302

(22) PCT Filed: Oct. 14, 2016

(86) PCT No.: PCT/EP2016/074770
§ 371 (c)(1),
(2) Date: Apr. 18, 2018

(87) PCT Pub. No.: WO2017/064281
PCT Pub. Date: Apr. 20, 2017

(65) Prior Publication Data

US 2018/0265944 A1 Sep. 20, 2018

(30) Foreign Application Priority Data

Oct. 15, 2015 (EP) ..... 15189940

(51) Int. Cl.
*C21D 9/46* (2006.01)
*C21D 1/34* (2006.01)
(Continued)

(52) U.S. Cl.
CPC ..... *C21D 9/46* (2013.01); *C21D 1/34* (2013.01); *C21D 1/673* (2013.01); *C21D 8/0205* (2013.01);
(Continued)

(58) Field of Classification Search
CPC combination set(s) only.
See application file for complete search history.

(56) References Cited

U.S. PATENT DOCUMENTS 4,585,901 A * 4/1986 Miller ..... C23C 14/022 174/394
2009/0320968 A1 12/2009 Boeke et al.
(Continued)

FOREIGN PATENT DOCUMENTS

DE 10336960 A1 3/2005
DE 102012016075 A1 12/2013
(Continued)

OTHER PUBLICATIONS

English language machine translation of DE102012016075. Generated Nov. 21, 2019. (Year: 2019).*
(Continued)

*Primary Examiner* — Brian D Walck
(74) *Attorney, Agent, or Firm* — Kagan Binder, PLLC

(57) ABSTRACT

The present invention relates to a method, and system for performing such method, for producing a press hardened part (2') of heat treatable material having zones of different structure by partially heating a blank (2) before the blank is processed. The method (100) comprises the steps of arranging (104) the blank in a furnace (10) for heating the blank to a temperature equal to or above the austenitization temperature of the material of the blank to get the blank into an austenitic phase, in a IR heating station (10) partially heating (106), by means of IR radiation (24), at least one first zone
(Continued)

(2*a*) of the blank thereby keeping the at least one first zone of the blank in the austenitic phase, and arranging (108) the blank in a processing unit (30) for forming and quenching the blank to a press hardened part.

8 Claims, 6 Drawing Sheets

(51) Int. Cl.

| | |
|---|---|
| ***F27D 11/12*** | (2006.01) |
| ***C21D 1/673*** | (2006.01) |
| ***C21D 8/02*** | (2006.01) |

(52) U.S. Cl.
CPC ..... *C21D 8/0247* (2013.01); *C21D 8/0294* (2013.01); *F27D 11/12* (2013.01); *C21D 2221/00* (2013.01)

(56) References Cited

U.S. PATENT DOCUMENTS

| | | | |
|---|---|---|---|
| 2011/0132897 | A1 | 6/2011 | Ishiguro et al. |
| 2012/0090741 | A1 | 4/2012 | Pellmann et al. |
| 2012/0135263 | A1 | 5/2012 | Kobayashi et al. |
| 2016/0076116 | A1 | 3/2016 | Baettenhausen et al. |

FOREIGN PATENT DOCUMENTS

| | | | |
|---|---|---|---|
| DE | 102013104229 | B3 | 10/2014 |
| DE | 202014010318 | U1 | 4/2015 |
| EP | 2463395 | A1 | 6/2012 |
| EP | 2548975 | A1 | 1/2013 |
| EP | 2799559 | A1 | 11/2014 |
| EP | 2322672 | B1 | 10/2018 |
| WO | 2010112122 | A1 | 10/2010 |
| WO | 20140118723 | A2 | 8/2014 |
| WO | 20140118724 | A1 | 8/2014 |
| WO | 205110456 | A1 | 7/2015 |

OTHER PUBLICATIONS

Strahlungsheizung', retrieved from https://de.wikipedia.org/wiki/Strahlungsheizung on Sep. 18, 2018, (English translation retrieved by clicking the 'English' button on the Wikipedia web-page), (9 pages).

Infrarotstrahlung', retrieved from https://de.wikipedia.org/wiki/Infrarotstrahlung on Sep. 18, 2018, (English translation retrieved by clicking the 'English' button on the Wikipedia web-page), (24 pages).

Notice of Opposition for European Application No. 21077356 mailed Sep. 30, 2019 (18 pages).

International Search Report for International Application No. PCT/EP2016/074770 dated Feb. 3, 2017 (4 pages).

* cited by examiner

PARTIAL RADIATION HEATING METHOD FOR PRODUCING PRESS HARDENED PARTS AND ARRANGEMENT FOR SUCH PRODUCTION

CROSS-REFERENCE TO RELATED APPLICATIONS

The application claims priority to International Application No. PCT/EP2016/074770 filed Oct. 14, 2016 and titled "PARTIAL RADIATION HEATING METHOD FOR PRODUCING PRESS HARDENED PARTS AND ARRANGEMENT FOR SUCH PRODUCTION", which in turn claims priority from European Application having serial number 15189940.8, filed on Oct. 15, 2015, both of which are incorporated herein by reference in their entities.

TECHNICAL FIELD

The present disclosure relates to production of shaped components, and especially the production of press hardened parts having zones of different microstructure.

BACKGROUND

Normally press hardened parts show a uniform strength distribution. Especially for safety relevant parts with high requirements concerning crash performance, this uniform strength distribution can cause problems. During a crash a B-pillar can e.g. absorb more energy when the lower part is relatively flexible while the middle and upper part has to be high-tensile to prevent the intrusion into the passenger compartment. There are known methods for adjusting the properties within press hardened parts. For instance methods of tailored rolled blanks, tailored welded blanks, tailored tempering in the press hardening tool and tailored heating. These methods are used to create soft/hard zones within a press hardened part.

A drawback of all of these methods is that they can only tailor the properties in big areas. Further, disadvantages of tailored welded blanks and tailored rolled blanks are that they become expensive to produce which will increase the part price, they require expensive tooling since they need good contact pressure, and they require advanced process control due to tight process window.

Tailored tempering in the tool has disadvantages of causing part distortion after rejection of the parts, causes high tool wear, and generates high tool costs.

Existing technologies of tailored heating have disadvantages of large transition zones between soft/hard zones, difficulties of reproducibility, causes high process costs, and are only suitable for big areas of parts (e.g. ⅓ of a B-pillar).

Consequently, there is a need of a method of tailoring the properties of a press hardened part, which method is cost effective, do not require advanced process control, and may adjust properties of smaller areas of the part.

SUMMARY

It is an object of the present invention to provide an improved solution that alleviates the mentioned drawbacks with present solutions. Furthermore, it is an object to provide a method and arrangement for the production of press hardened parts using partial radiation heating.

According to a first aspect of the invention, this is provided by a method for producing a press hardened part of heat treatable material having zones of different structure by partially heating a blank before the blank is processed. The method comprises the steps of arranging the blank in a furnace for heating the blank to a temperature equal to or above the austenitization temperature of the material of the blank to get the blank into an austenitic phase, in a radiation heating station partially heating, by means of radiation, at least one first zone of the blank thereby keeping the at least one first zone of the blank in the austenitic phase, and arranging the blank in a processing unit for forming and quenching the blank to a press hardened part.

During the forming of the press hardened part, the at least one first zone of the blank may be in the austenitic phase. The blank may further comprise at least one second zone being outside said at least one first zone and not exposed to said radiation. This partial heating of the blank using radiation heating may provide that the zone or zones of the press hardened part corresponding to the at least one first zone of the blank being in the austenitic phase when being formed and quenched will have a different structure than parts of the blank in said at least one second zone. The partially heated at least one first zone of the blank may become hardened when formed and quenched in the processing unit. I.e. the at least one first zone of the blank may enter a martensite phase when it has been formed and quenched. In the at least one second zone, the blank may not be hardened when formed and quenched, or at least be provided with a different internal structure than in the at least one first zone. The at least one second zone may for instance enter a ferrite and pearlite phase when it has been formed and quenched. The different internal structure may be different internal microstructure.

In the radiation heating station, radiation sources may be arranged to provide radiation to the at least one first zone of the blank. The arrangement of radiation sources may be designed to provide radiation to the at least one first zone only. Alternatively, the radiation heating station may comprise radiation sources in an arrangement covering the entire blank, and only the radiation sources providing radiation to the at least one first zone of the blank may be activated to heat the at least one first zone. For instance, radiation sources may be arranged in a matrix pattern, and when heating the blank using the radiation sources, specific radiation sources may be controlled to be activated to heat the blank in a certain pattern.

By arranging the blank in a radiation heating station being separate from the furnace, the partial heating of the blank may be precisely controlled. A furnace normally provides a surrounding heating of the blank, providing heat to the blank from several direction. A time efficient heating of the blank to the rather high temperature needed for austenitization may then be provided. It may therefore be energy efficient to have a separate radiation heating station for the partial heating, which heating station maintains the austenitic phase in the at least one first zone.

By using a method wherein the entire blank is heated into the austenitic phase, and wherein at least one first zone thereafter is kept in the austenitic phase while at least one second zone may be left to cool out of the austenitic phase, the temperatures in the first and the second zones at forming and quenching of the blank may be controlled. Thereby, the internal structure in the first and second zones in the press hardened part may be controlled. Further, by heating both the first and second zones into the austenitic phase, it may be facilitated to control the phase in which the at least one second zone is when forming and quenching the blank. For instance, it may be desired to have the at least one second zone in a ferrite, pearlite or bainite phase, or a mixture thereof or a mixture of such phase with austenite, when forming and quenching the blank. This may provide a good formability of all zones of the blank. Such phase mixture may further be wanted in order to control the strength level in the material of the blank in the at least one second zone.

If not heating also the second zone of the blank to the austenitic phase, there may be difficulties in controlling at which temperature the at least one second zone is when forming and quenching. Between the at least one first zone of the blank and the at least one second zone, a transition zone may be created when the temperatures of the at least one first and second zone differs. In such transition zone the blank may be in a mixed phase of ferrite, pearlite, bainite and/or austenite.

Further, the temperature difference between the first zone and the second zone may be too large, i.e. the second zone may be too cold, when reaching forming and quenching. If the blank is made of a coated material, such as AlSi coating, there may also be a need for heating also the at least one second zone, i.e. the parts of the blank not to be hardened, to the austenitic phase, in order to provide necessary reaction between the coating and the base material of the blank. The blank may be a steel blank.

The blank may be heated to a temperature equal to or above the austenitization temperature, and kept at that temperature for an amount of time until the material of the blank enters the austenitic phase.

With partial radiation heating, as a solution for tailored heating after the austenitization in the furnace, it is possible to create both very large areas that vary in properties and very precisely defined areas with different strengths/properties. Also during the production of press hardened parts, the high strength causes trouble. When the trimming takes place after the hardening process, the durability of the tool is limited. Soft zones, i.e. zones of the blank outside said at least one first zone, may reduce the wear of a cutting tool, reduce the required machine force and increase the lifetime of the processing unit.

The present method using partial radiation heating may be integrated into existing press hardening lines. The basic material may not need to be changed. A new way of thinking in terms of crash load paths is possible since the properties in the part may be adjusted very locally. The method using partial radiation heating may enable both very local heating and heating of big areas of a blank. This is due to the use of radiation for keeping the temperature in the selected at least one first zone. The radiation may be provided only to specific zones of the blank, in certain areas or in a certain path. The temperature of the blank in the at least one first zone may thereby be controlled. When the blank then is arranged in the processing unit to be formed by a tool, the at least one first zone kept in the austenitic phase by the radiation heating may be hardened, while the other zones of the blank, having cooled out of the austenitic phase, may not be hardened.

The entire blank may be formed and quenched in the processing unit. I.e. both the at least one first zone of the blank and the rest of the blank may be formed and quenched.

In the method according to the invention, more than one blank may be heated in the furnace and/or partially heated in the radiation heating station at the same time. The furnace may comprise a plurality of heating chambers, each configured to receive a blank. The radiation heating station may be configured for receiving one or more blanks simultaneously for partial radiation heating. The effectiveness in the production process may thereby be increased.

According to one embodiment, the radiation heating station may be an infrared heating station and the step of partially heating the at least one first zone may be performed by means of infrared radiation. Infrared radiation may be an effective way of heating the at least one first zone. The infrared heating station may be provided with a plurality of infrared light sources used to radiate the at least one first zone. By infrared radiation it may in one embodiment be meant electromagnetic radiation with wavelengths primarily between 0.7 μm and 1 mm. Preferably, infrared radiation having a wavelength primarily between 0.8 μm and 3 μm may be used. More preferably, infrared radiation in the so called near-infrared (NIR or IR-A) spectrum may be used, having a wavelength primarily between 0.8 μm and 1.5 μm. The infrared radiation in the NIR spectrum reaches a high energy density and may thereby become effective for radiation heating of the blank. One alternative may be infrared radiation in the short-wavelength infrared (SWIR or IR-B) spectrum, having a wavelength between 1.4 and 3 μm. Also short-wavelength infrared may provide infrared radiation having a high energy density making it effective for the blank radiation heating. This may be summarized as infrared radiation having a wavelength of less than 3 μm, preferably less than 2 μm to provide further high energy density, or preferably between 0.7 and 2 μm in which range the most effective heating of the blank takes place. Most preferably, a wavelength spectrum having its peak at 0.8 μm may be used in order to be the most efficient for certain metal material.

Further, the step of partial heating in the radiation heating station may comprise a step of arranging a mask between a radiation source and the blank to block radiation from reaching outside said at least one first zone of the blank. The mask may be formed in a specific pattern to provide a desired form of the at least one first zone. The pattern of the mask may correspond to the desired shape of the at least one first zone of the blank. The mask may be formed as a sheet shaped radiation mask having at least one opening through which the radiation passes to reach the blank in said at least one first zone. The radiation heating station may be provided with radiation sources providing radiation towards one side, e.g. an upper side, of the blank. The mask may be arranged between the radiation sources and the upper side of the blank. A bottom side of the blank may be substantially free from radiation exposure in the radiation heating station. The blank may be placed on a support providing shielding of the bottom side from the radiation.

Using such method with the arrangement of the mask, a very detailed and complex pattern of the at least one zone of the blank heated by the radiation may be provided compared to what is possible with known methods. The structure of the press hardened part may thereby be tailored in correspondingly detailed and complex manner. When using a mask to block radiation from reaching outside the desired areas or paths of the blank, no control of specific radiation sources may be needed. Even if all radiation sources are active, the mask will make sure the radiation only reaches the at least one first zone of the blank intended. The mask may be provided in a highly reflective material to control the amount of radiation that passes through to the blank. Such material may be aluminum or stainless steel, possibly polished. Further the material of the mask may be provided with a chromium layer. In one embodiment, the mask may be configured to block infrared radiation from reaching outside of the at least one first zone of the blank. Further, the mask may be positioned in direct contact with the blank. A plane upper surface of the blank may be in contact with a plane bottom surface of the mask.

In one embodiment, the mask may be arranged substantially in parallel with the blank in the radiation heating station, or substantially perpendicular to the direction of the radiation. The radiation may then be effectively blocked from reaching outside the desired areas of the blank, i.e. outside the at least one first zone to be kept in the austenitic phase.

In a further embodiment, the mask may be arranged to cover outer boundaries of the blank, having openings and/or recesses to provide the radiation to reach the at least one first zone of the blank. Thereby, the heating of the entire blank may be tailored to provide a desired heating pattern.

In another embodiment, the mask may be arranged in direct contact with the blank. This may provide an improved IR heating wherein less radiation may escape outside the first zone of the blank. In a further embodiment, a plane upper surface of the blank may be arranged in contact with a plane bottom surface of the mask. The blank and the mask may thereby be arranged in parallel manner in direct contact with each other. The outer boundaries of the mask may extend outside the outer boundaries of the blank. I direct contact between the plane surfaces of the blank and the mask may provide an IR heating in the at least first zone that is controlled in detail, enabling a high resolution pattern of the first and second zones.

In one embodiment, the blank may be kept in the infrared heating station for a time between 8 and 100 seconds, providing a cooling of the second zone of the blank to between 550° C. and 750° C. depending on the cooling speed. The time for which the blank is kept in the IR station may be selected depending on the cooling speed that can be achieved in the IR station. A fast cooling, when the blank is kept for about 8 seconds, may require a temperature in the second zone of about 550° C. At that cooling speed, the needed transformation in the material of the blank occurs at about 550° C. If the blank is kept in the IR station for a longer time, for instance about 100 seconds with a lower cooling speed, a higher temperature of the second zone may be accepted since the same transformation then occurs already at about 750° C.

According to a second aspect of the invention, an arrangement for producing a press hardened part of heat treatable material having zones of different structure may be provided. The arrangement comprises a furnace configured to receive a blank and heating the blank to a temperature equal to or above the austenitization temperature of the material of the blank to get the blank into an austenitic phase, a radiation heating station configured to partially heat, by means of radiation, at least one first zone of the blank thereby keeping the said first zone of the blank in the austenitic phase, and a processing unit configured to receive the partially heated blank and to form and quench the blank to a press hardened part. The arrangement may be configured to perform the above presented method for producing a press hardened part. The arrangement may have similar properties and advantages as presented for the method above.

The arrangement may comprise a transportation unit configured to transport the blank between the furnace, the radiation heating station and the processing unit. The transportation unit may be configured to transport the blank in a way such that the heat loss of the blank is as low as possible. Similarly as discussed regarding the method above, the arrangement may be capable of receiving one or more blanks simultaneously for heating in the furnace and/or partial heating in the radiation heating station.

In one embodiment, the radiation heating station may be an infrared heating station configured to partially heat the blank using infrared radiation. Infrared radiation may be an effective way of heating the at least one first zone. The infrared heating station may be provided with a plurality of infrared light sources used to radiate the at least one first zone. Besides infrared radiation, any type of radiation suitable for heating the at least one first zone of the blank to an austenitic phase temperature may be used. Such other type of radiation may be resistant heat radiation or radiant heat radiation.

In one embodiment, the radiation heating station may comprise a mask arranged between a radiation source and the blank, the mask being configured to block radiation from reaching outside said at least one first zone of the blank. The mask in such arrangement may be used for create specific desired patterns or paths of the at least one zone and of the structure of the final press hardened part as explained above.

The mask may in one embodiment be arranged in parallel with the blank in the radiation heating station. The mask may thereby control all the radiation that can reach the blank. The mask may further be provided with at least one opening or recess. The design of the opening or recess may provide a desired pattern or path of the radiation that can reach the blank, and thereby the pattern or path of the at least one first zone of the blank.

The mask may further be arranged to be in direct contact with the blank as discussed above. Further, a plane bottom surface of the mask may be configured to be in direct contact with a plane upper surface of the blank that is to be received in the IR heating station, as further discussed above.

BRIEF DESCRIPTION OF THE DRAWINGS

The invention will in the following be described in more detail with reference to the enclosed drawings, wherein.

DESCRIPTION OF EMBODIMENTS

Figure 1:
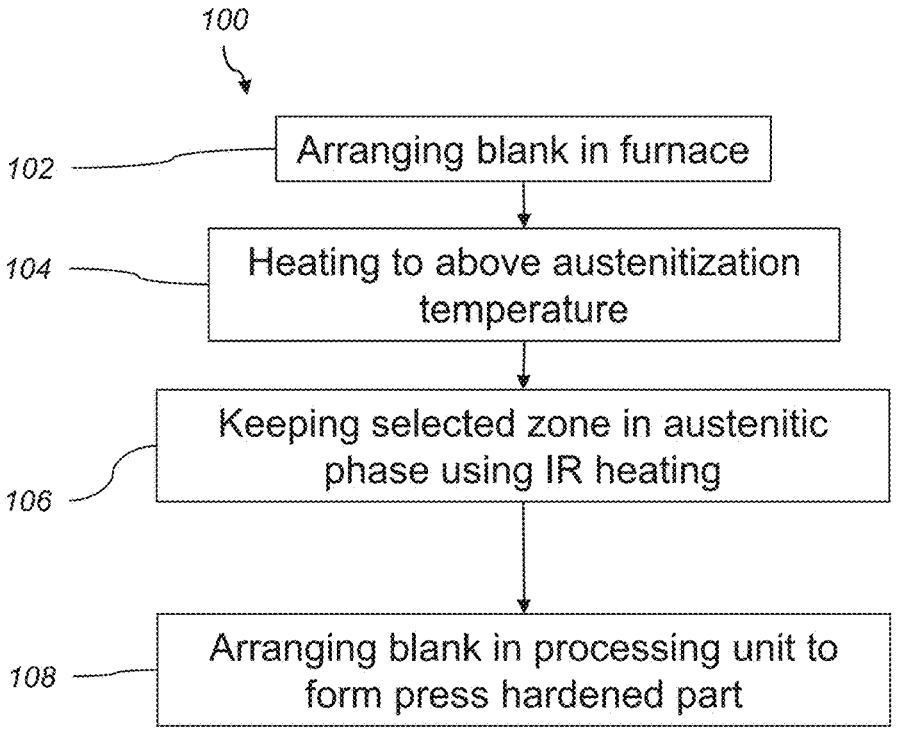
FIG. 1 shows a flow chart of a method according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

FIG. 1 illustrates a method 100 for producing a press hardened part according to an embodiment of the invention. The method 100 comprises a step 102 of arranging a blank in a furnace. In the furnace, the blank is heated 104 to a temperature equal to or above the austenitization temperature of the material of the blank. Such heating puts the blank in an austenitic phase. The entire blank may be heated in the furnace, or a section of the blank may be heated in the furnace. For instance, a first section of the blank may be inserted into the furnace for heating, while a second section of the blank may extend outside the furnace during heating. The blank may be held in place into the furnace by an apparatus holding the blank at the second section.

The method 100 further comprises a step 106 of keeping at least one first zone of the blank at a temperature for the austenitic phase using radiation heating. At the same time, parts of the blank outside said at least one first zone is allowed to cool to a temperature exiting the austenitic phase.

After the step 106 of radiation heating of the at least one first zone, the blank is arranged 108 in a processing unit to be formed and quenched to a press hardened part. When the blank is formed, the at least one first zone is in the austenitic phase. Further, when being formed in the processing unit, the blank is cooled, such that the at least one first zone of the blank being in the austenitic phase becomes hardened.

The method 100 may use infrared heating as radiation heating to keep the first zone in the austenitic phase.

Figure 2:
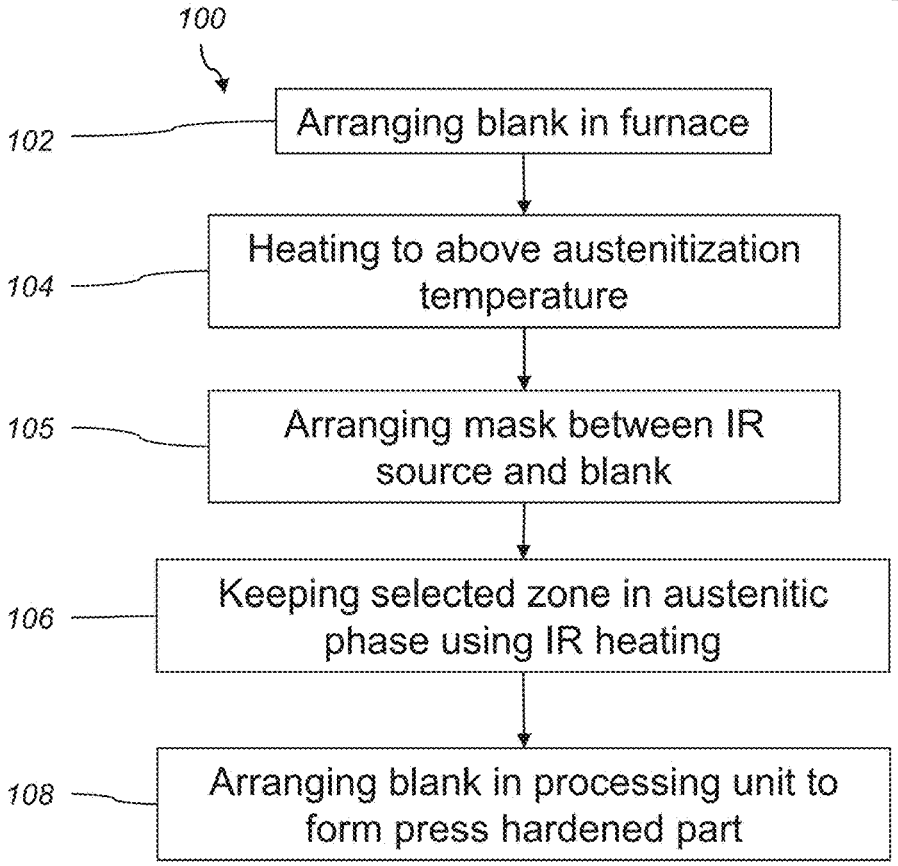
FIG. 2 shows a flow chart of a method according to an embodiment of the invention.

FIG. 2 illustrates another embodiment of the method 100 of FIG. 1, further comprising a step of arranging 105 a mask between the radiation source and the blank in the radiation heating station. The mask and the use thereof will be further discussed below.

The method 100 above may use infrared heating as radiation heating to keep the first zone in the austenitic phase.

Figure 3:
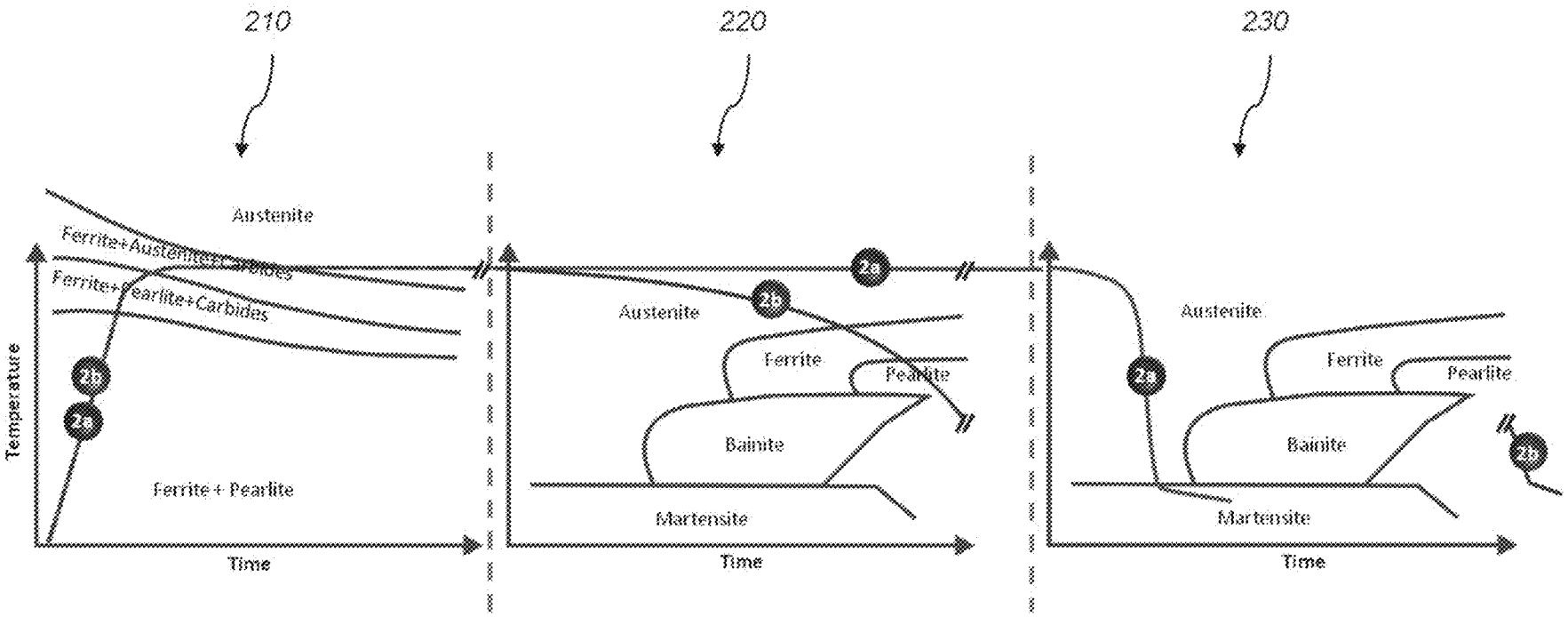
FIG. 3 shows a schematic diagram of the internal structure of a blank during a method process according to an embodiment of the invention.

FIG. 3 illustrates how the internal structure in a steel blank may change in different zones using a method according to the present invention. In the figure, the temperature of the second zone 2*b* of the blank 2 outside the at least one first zone and the temperature of the least one first zone 2*a* of the blank 2 is illustrated. In the first stage 210, the entire blank is heated in the furnace to the austenitic phase. This includes heating the blank to a temperature equal to or above the $AC_3$ temperature of the blank, and keeping the blank at this temperature for an amount of time. In the second stage 220, the blank has been moved to the radiation heating station in which the at least one first zone 2*a* is kept at a temperature keeping it in the austenitic phase. Such temperature may be above the $AC_3$ temperature. The second zone 2*b* is cooling reaching ferrite, pearlite and bainite phase. In the third stage 230, the blank 2 is formed and quenched in the processing unit. When the at least one first zone 2*a* is rapidly cooled from the austenitic phase, it reaches martensite phase. When the second zone 2*b* is quenched, it stays in the pearlite phase which it had reached when previously been cooling. However, the second zone 2*b* may, before being quenched, have a mixture of ferrite, pearlite, bainite and/or austenite. Depending on the composition of phase in the second zone 2*b* before quenching, the internal structure and material strength level becomes different.

Figure 4A:
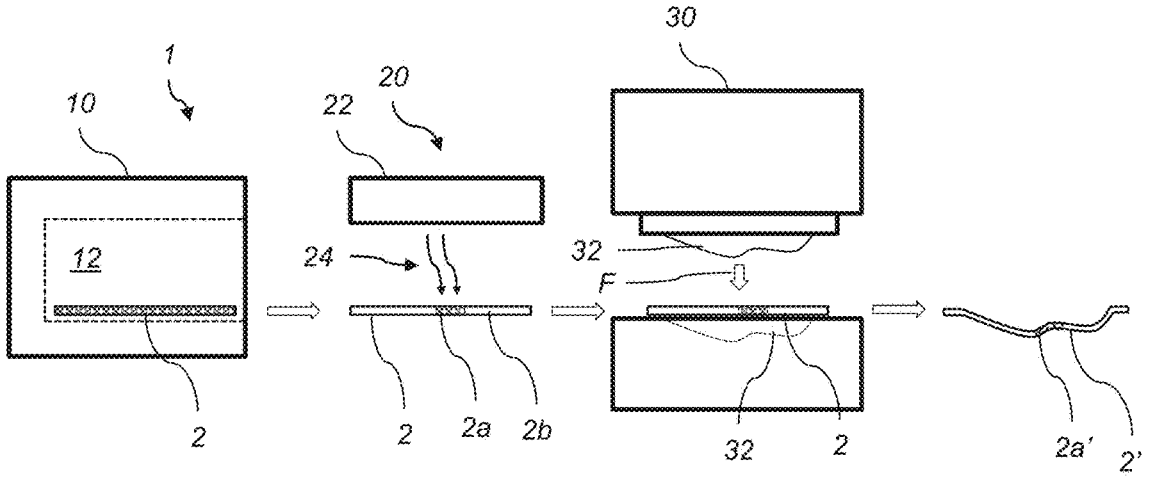
FIG. 4*a* shows a schematic block diagram of an arrangement according to an embodiment of the invention.
Figure 4B:
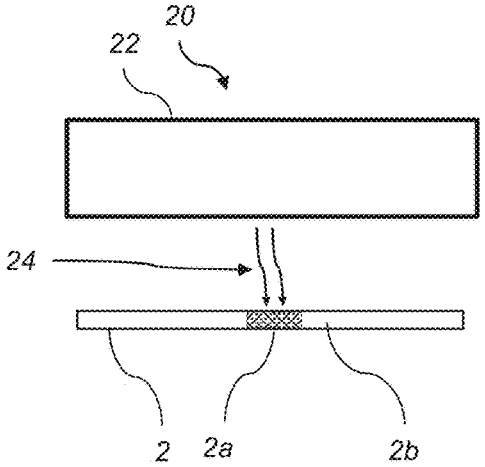
FIG. 4*b* shows a schematic block diagram of a part of an arrangement according to an embodiment of the invention.

FIG. 4*a* illustrates an arrangement 1 according to an embodiment of the present invention, and FIG. 4*b* a detailed view of the infrared heating station 20 according to the same embodiment. The arrangement 1 comprises a furnace 10 configured to receive a blank 2, or several blanks at once. The blank 2 is heated in the furnace 10 to a temperature equal to or above the austenitization temperature of the material of the blank 2. The material of the blank 2 is thereby put into the austenitic phase of the material.

The arrangement 1 further comprises an infrared heating station 20 configured to receive a blank 2 in a furnace interior 12. In the following, an embodiment of the arrangement 1 comprising an infrared heating station and using infrared heating will be discussed. However, what is said below may as well be applied on an embodiment using other kind of radiation and radiation heating station for the partial heating of the blank.

The blank 2 heated in the furnace 10 is moved to the infrared heating station 20. In the infrared heating station 20, at least one first zone 2*a* is exposed to infrared radiation 24 from an infrared light source 22. The at least one first zone may in this embodiment also be referred to as IR heated zone or zones. The IR heated zone 2*a* is thereby heated to be kept in the austenitic phase. The second zone or zones 2*b* of the blank 2 not being exposed to the infrared radiation 24 are permitted to cool to a temperature below the austenitization temperature and further out of the austenitic phase.

The infrared heating station comprises a plurality of infrared radiation sources. When exposing the blank to the radiation, the infrared radiation sources can be controlled to provide radiation to the first zone 2*a*. Specific radiation sources can be activated in a desired pattern to create a desired pattern of the at least one first zone 2*a*.

Further, the arrangement 1 comprises a processing unit 30 configured to receive a heated blank 2. The partially heated blank 2 is moved from the infrared heating station 20 to the processing unit 30, preferably rapidly. In the processing unit 30, the blank 2 is arranged in a tool 32. By being pressed by a pressing force F, and quenched, the blank 2 is formed to a press hardened part 2'. The press hardened part 2' has a hardened zone 2*a*' corresponding to the IR heated zone 2*a* on the blank 2.

In an exemplary embodiment, the blank 2 may in the furnace 10 be heated to a temperature around 930° C. and kept there to put the blank in the austenitic phase. The austenitization temperature for the blank 2 may typically be around 850° C. Using the infrared heating, the IR heated zone 2*a* of the blank is kept in the austenitic phase, and may when reaching the processing unit 30 for the forming and quenching have reached a temperature of about 780° C., i.e. still in the austenitic phase.

Figure 5A:
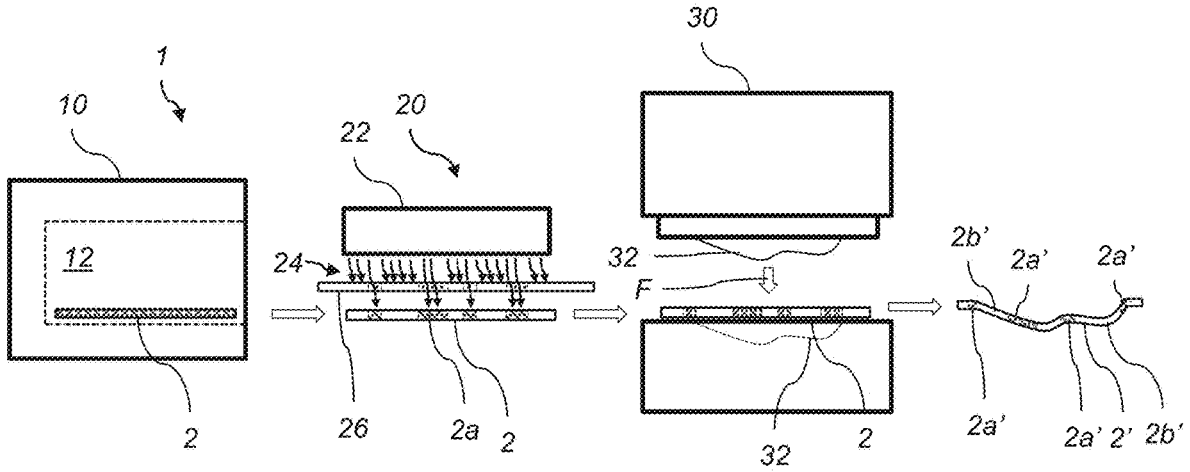
FIG. 5*a* shows a schematic block diagram of an arrangement according to an embodiment of the invention.
Figure 5B:
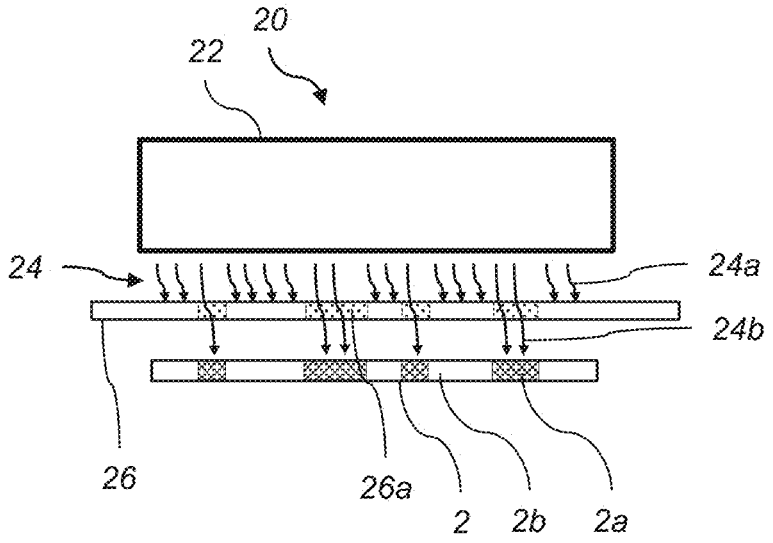
FIG. 5*b* shows a schematic block diagram of a part of an arrangement according to an embodiment of the invention.

FIG. 5*a* illustrates the arrangement 1 according to an alternative embodiment of the present invention, wherein the infrared heating station 20 further comprises a radiation mask 26. FIG. 5*b* further illustrates a detailed view of the infrared heating station 20 according to the same embodiment. The radiation mask 26 is arranged between the infrared light source 22 and the blank 2. The radiation mask 26 is provided with one or more openings or recesses 26*a*. The radiation mask 26 thereby blocks the infrared radiation 24 from reaching the blank 2 except at the openings 26*a*, through which the infrared radiation 24 extends to the blank 2.

The openings 26*a* in the radiation mask 26 may be designed in a pattern corresponding to specific first zone or zones 2*a* of the blank 2 desired to be exposed to the radiation 24 to become hardened when being formed and quenched. The first zones 2*a* of the blank 2 are thereby heated while the second zones 2*b* outside the first zones 2*a* are not. When the blank 2 thereafter is moved to the processing unit 30 and formed to a press hardened part 2', different structure in different zones 2*a*, 2*b* of the blank 2 is achieved due to the different temperatures in the different zones 2*a*, 2*b*. The different temperatures may be related to the material of the zones 2*a*, 2*b* being in the austenitic phase or not. The different structured zones 2*a*, 2*b* of the blank 2 result in different structured or different hardened zones 2*a*', 2*b*' on the press hardened part 2'.

Figure 6:
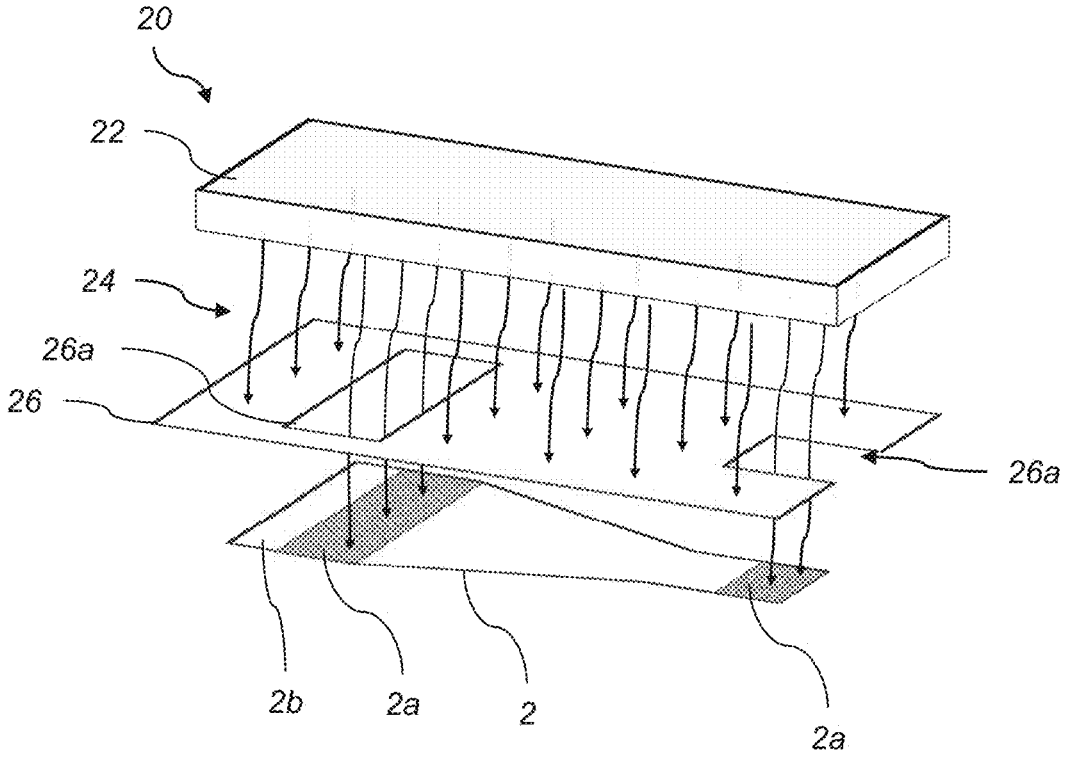
FIG. 6 shows a schematic perspective view of a part of an arrangement according to an embodiment of the invention.
Figure 7:
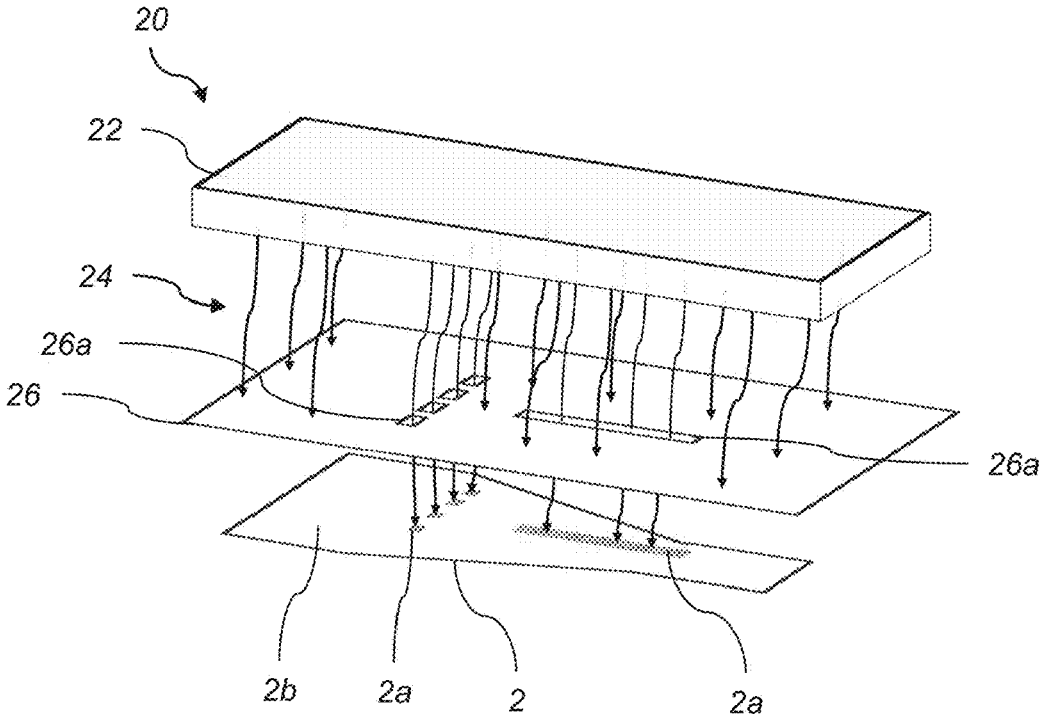
FIG. 7 shows a schematic perspective view of a part of an arrangement according to an embodiment of the invention.

This is further illustrated in FIGS. 6 and 7, wherein a mask 26 having opening/recess 26*a* to enable infrared radiation 24 from the infrared light source 22 to reach the blank 2 at the intended IR heated zone 2*a*, and to block the radiation 24 from reaching outside (2*b*) the intended IR heated zone 2*a*. The mask 26 is arranged in a plane in parallel with the blank 2. The size of the mask 26 is larger than the size of the blank 2 to enable tailored heating of the entire blank 2. The mask 26 is provided with openings and recesses 26*a* that may be small to provide a detailed tailoring of the IR heated zone or zones 2*a* on the blank 2. However, in some embodiments, the openings and recesses 26*a* may be large, i.e. that most area of the blank 2 is not covered by the mask 26, and only small areas are covered to provide cooled soft zones.

Figure 8:
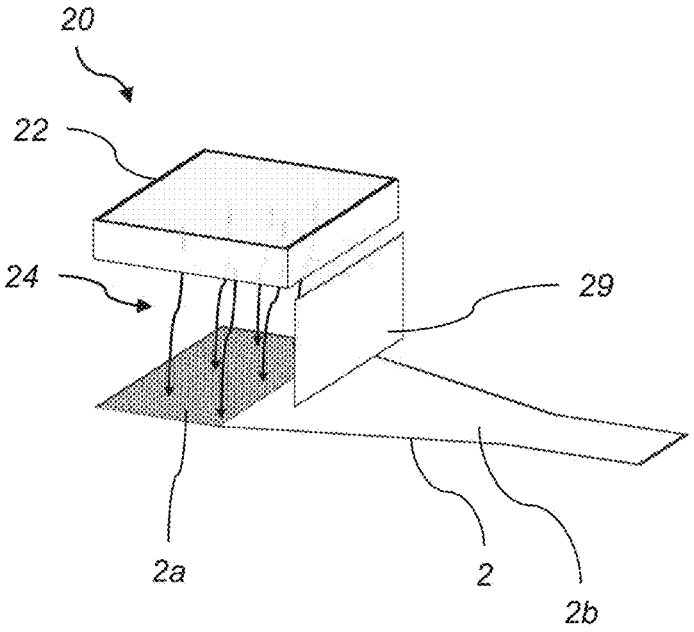
FIG. 8 shows a schematic perspective view of a part of an arrangement according to an embodiment of the invention.

As illustrated in FIG. 8, an embodiment of the invention may comprise a radiation heating station 20 in which the radiation source 22 extends over only a section of the blank 2. The radiation 24 will thereby only reach the first zone 2*a* of the blank 2 that will be hardened. Optionally, a shield 29 may be used to block radiation 24 from reaching outside the intended first zone 2*a*. The second zone 2*b* may thereby be kept from radiation exposure and not heated by the radiation 24.

Figure 9:
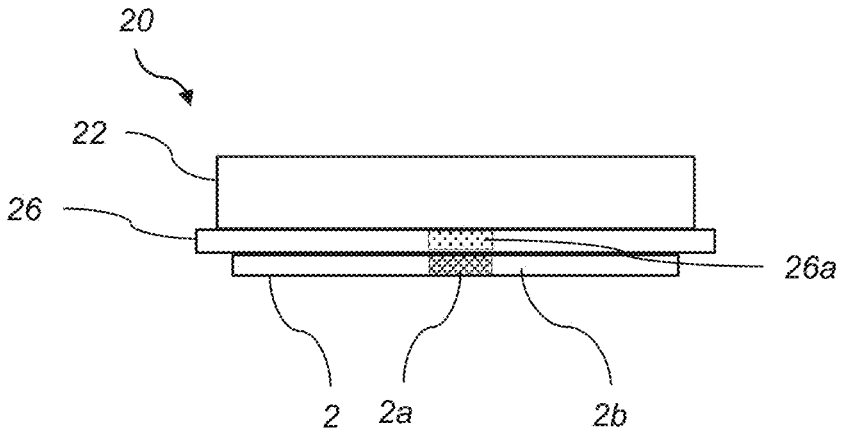
FIG. 9 shows a schematic side view of a part of an arrangement according to an embodiment of the invention.

As illustrated in the embodiment of FIG. 9, the radiation heating station 20 comprises a mask 26 in plane and parallel direct contact with the blank 2. The opening 26*a* thereby in very detail control the extension of the radiation from the radiation source 22 to the first zone 2*a* of the blank 2. The mask 26 may further be in plane direct contact with the radiation source 22.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A method for producing a press hardened part of heat treatable material having zones of different structure by partially heating a blank before the blank is processed, comprising the steps of;

arranging the blank in a furnace for heating the blank to a temperature equal to or above the austenitization temperature of the material of the blank to get the blank into an austenitic phase, arranging the heated blank in an infrared (IR) heating station comprising IR radiation sources configured to provide IR radiation towards an upper side of the blank, wherein the blank is arranged on a support providing shielding of a bottom side of the blank such that the bottom side of the blank is substantially free from radiation exposure from the IR radiation, arranging a mask made of stainless steel or aluminum between the IR radiation sources and the upper side of the blank, in parallel with the blank, to block IR radiation from reaching outside at least one first zone of the blank, partially heating, by means of IR radiation, said at least one first zone of the blank thereby keeping the at least one first zone of the blank in the austenitic phase and letting a second zone of the blank, outside said at least one first zone, to cool below the austenitization temperature, and arranging the blank in a processing unit for forming and quenching the blank to a press hardened part.

2. The method according to claim 1, wherein the mask is provided with one or more opening or recess for radiation to pass through to reach the blank.

3. The method according to claim 1, wherein the mask is arranged in direct contact with the blank.

4. The method according to claim 3, wherein a plane upper surface of the blank is arranged in contact with a plane bottom surface of the mask.

5. The method according to claim 1, wherein the infrared radiation is in the spectral range between 0.7 and 3 μm.

6. The method according to claim 5, wherein the infrared radiation is in the near-infrared (NIR) spectrum having a wavelength between 0.8 and 1.5 μm.

7. The method according to claim 1, wherein the blank is kept in the IR heating station for a time between 8 and 100 seconds, providing a cooling of the second zone of the blank to between 550° C. and 750° C. depending on the cooling speed.

8. The method according to claim 1, wherein the infrared radiation is in the spectral range between 0.7 and 2 μm.

* * * * *